US005538245A

United States Patent [19]

Moore

[11] Patent Number: 5,538,245

[45] Date of Patent: Jul. 23, 1996

[54] GOLF CLUB WITH ADJUSTABLE HEAD

[76] Inventor: Donald D. Moore, 3711 Tamarisk Ave., Beverly Hills, Fla. 34465

[21] Appl. No.: 493,940

[22] Filed: Jun. 23, 1995

[51] Int. Cl.[6] ..... A63B 53/08

[52] U.S. Cl. ..... 473/239; 403/97; 473/247; 473/325

[58] Field of Search ..... 273/79, 168, 80.1, 273/80.2, 167 R, 80 D; 403/97

[56] References Cited

U.S. PATENT DOCUMENTS

| | | | |
|---|---|---|---|
| 2,091,794 | 8/1937 | Pester | 273/79 |
| 2,477,438 | 7/1949 | Brouwer | 273/79 |
| 2,576,866 | 11/1951 | Verderber | 273/79 |
| 2,777,694 | 1/1957 | Winter | 273/79 |
| 2,882,053 | 4/1959 | Lorthiois | 273/79 |
| 3,840,231 | 10/1974 | Moore | 237/79 |
| 5,083,779 | 1/1992 | Ungermann | 273/168 |
| 5,133,553 | 7/1992 | Divnick | 273/79 |

*Primary Examiner*—Sebastiano Passaniti
*Attorney, Agent, or Firm*—Edward M. Livingston

[57] ABSTRACT

An adjustable head golf club has a selection ring (16) positioned with shank end ratchet teeth (19) in ratchet relationship to shank ratchet teeth (20) and with head end ratchet teeth (17) in ratchet relationship to head ratchet teeth (18). A fastener rod (4,10) is extended intermediate a club attachment base (11) on the back side (29) of the club head (1) and a shank attachment base (12) on a shank (2). A fastener head (44, 45, 46) of the fastener rod can be buttressed either against an inward side of the club attachment base or against an outward side of a shank attachment base, depending on design preferences. A plurality of shank end ratchet teeth and shank ratchet teeth is different from a plurality of head end ratchet teeth and head ratchet teeth. The shank end ratchet teeth are designedly offset circumferentially to provide vernier type adjustment of face angle loft and handle angle lie by selective circumferential positioning of the selection ring between the head ratchet teeth and the shank ratchet teeth according to an alignment radius (62), alignment marks (63) and mode letters (60). For closed positioning of a telescopically closeable handle for travel mode, a shaft ring or ferrule (56) on the shaft is designedly eccentric to maintain closed mode conveniently.

39 Claims, 7 Drawing Sheets

FIG. 1
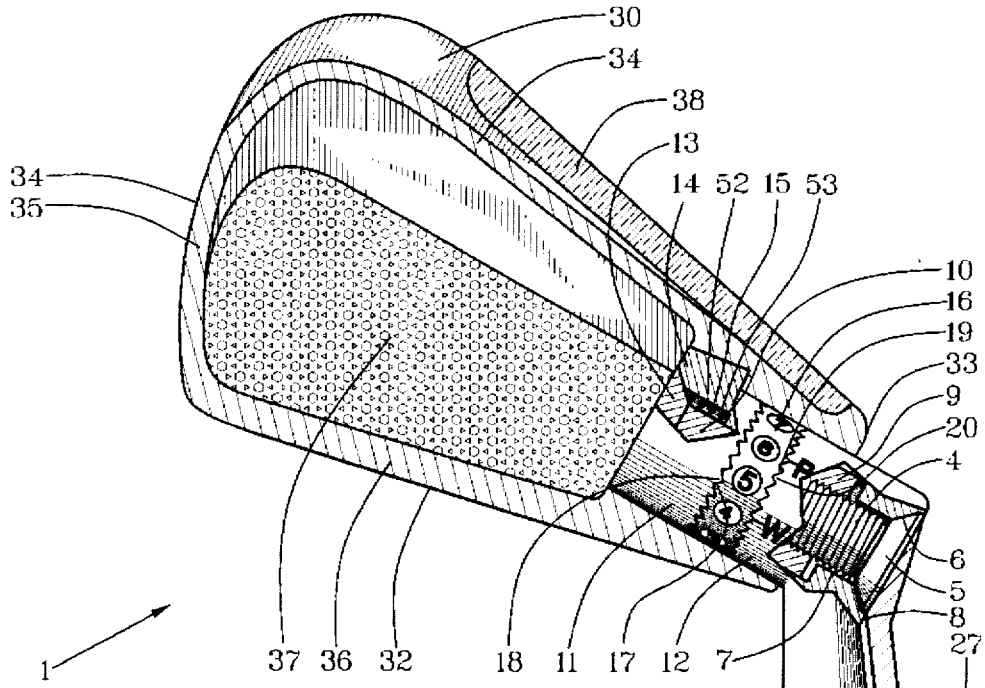
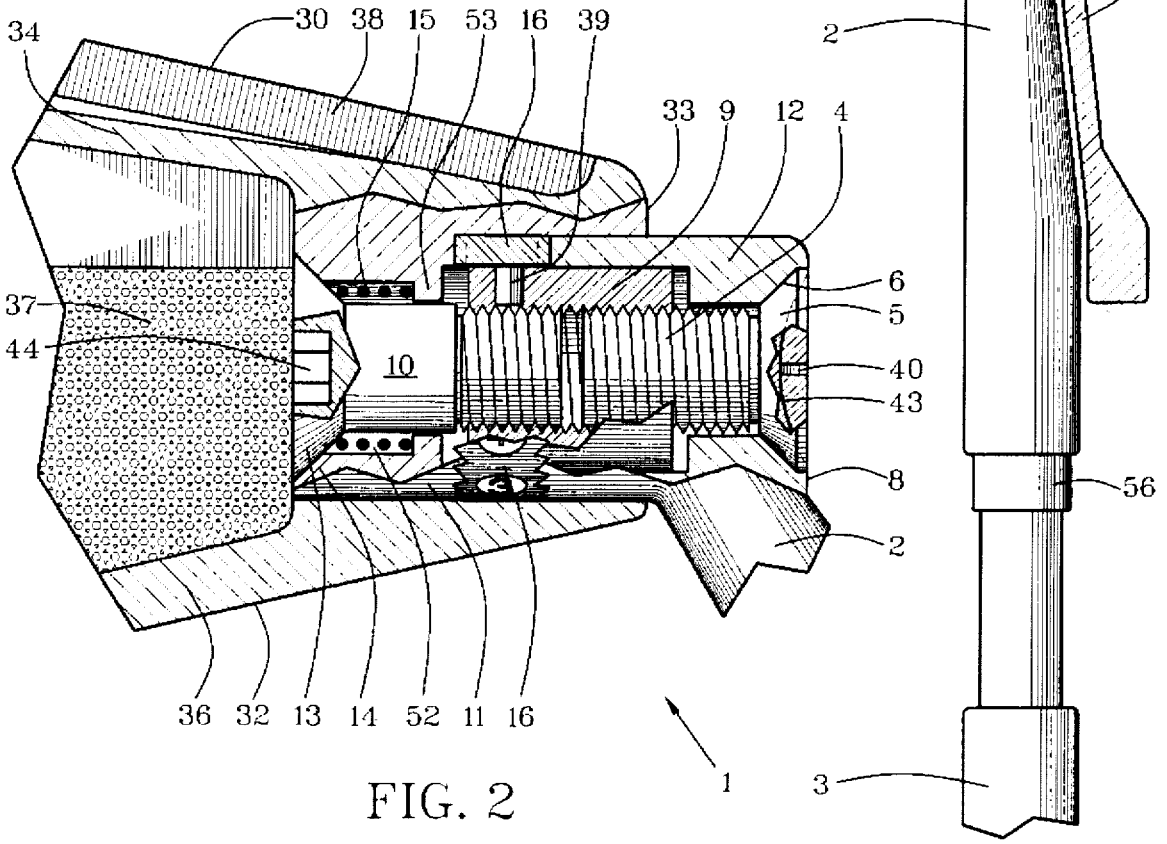
FIG. 2

FIG. 13
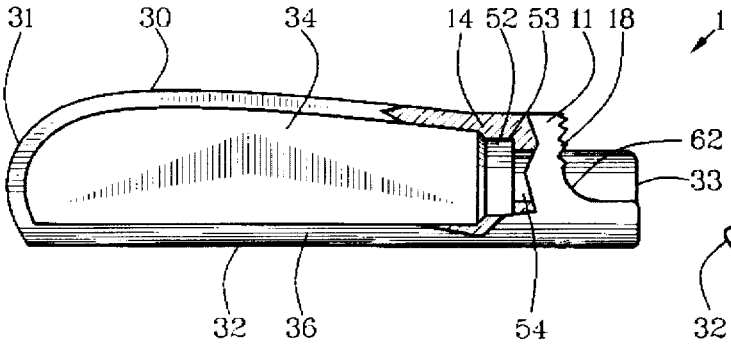
FIG. 14
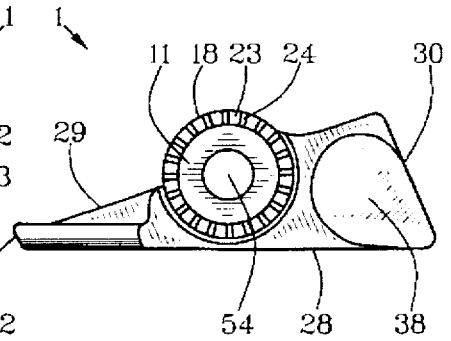
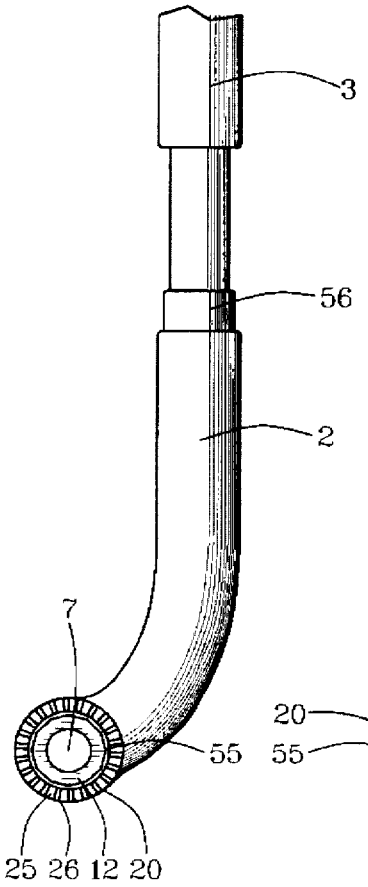
FIG. 15
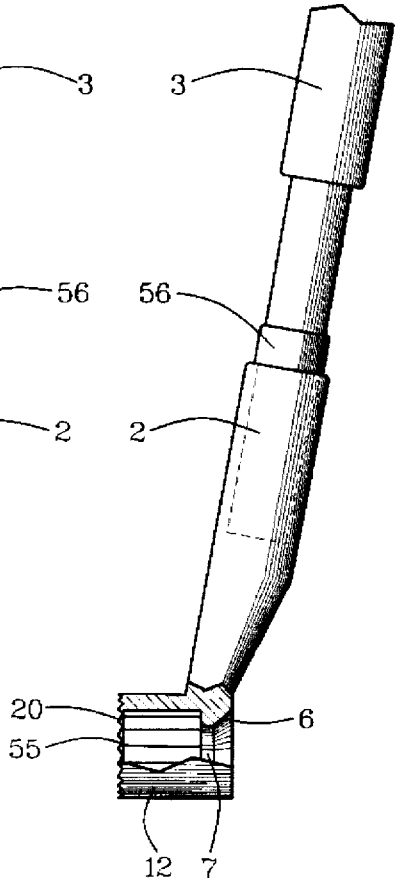
FIG. 16
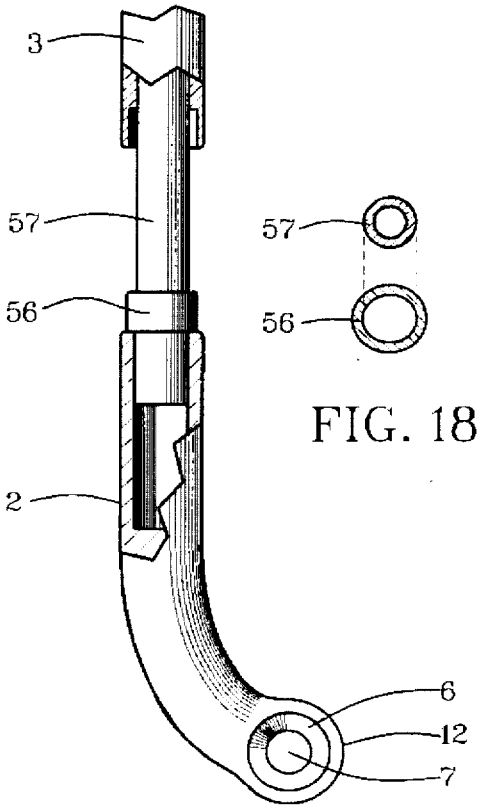
FIG.17
FIG. 18

GOLF CLUB WITH ADJUSTABLE HEAD

BACKGROUND OF THE INVENTION

This invention relates to adjustable golf clubs having heads with adjustable face angle (loft), adjustable handle angle (lie), and telescopically closeable handles. More particularly, it relates to ratchet rings for adjustment of golf head loft and lie and to attachment of telescopic club handles to heads of adjustable golf clubs.

A golf club adjustable to characteristics of all types and forms of golf clubs and having a telescopically closeable handle was taught by U.S. Pat. No. 3,840,231, issued to Moore (the present inventor) on Oct. 8, 1974. A basic feature of face angle loft adjustment and handle angle lie adjustment of the Moore patent was a form of ratchet ring positioned between a rotationally adjustable head and a shank to which a telescopically closeable handle was attachable. U.S. Pat. No. 5,133,553, issued to Divnick on Jul. 28, 1992, modified the Moore device to position the ratchet ring in a housing for protection from sand and other substances in addition to other related modifications of both the adjustable head and the telescopically closeable handle. Now, the Moore patent is being modified further by its original inventor for further improvements of both the former Moore patent and the Divnick patent.

The original Moore device extended an attachment bolt and related attachment means from end to end of a back side of a club head where it interfered with a later-popularized thin central area with impact yielding characteristics that has come to be known as a sweet spot of heads of iron number designated loft angle of golf clubs. Divnick patent solutions to this sweet-spot problem and to the purported sand exposure problem of the original Moore device, however, positioned the head too far laterally away from the shank for optimum club control. The housing in the Divnick patent actually created a trap for sand that could not be dislodged easily. Further, the Divnick patent did not provide the finesse of loft adjustment and lie adjustment of an impact face and a separate putting face on a single golf club head as taught by the present Moore invention.

SUMMARY OF THE INVENTION

In light of problems that have existed and that continue to exist in this field, objectives of this invention are to provide a single adjustable head golf club which:

Can be adjusted accurately, conveniently and quickly to conventionally and professionally standardized face angle loft, handle angle lie and other characteristics of all golf clubs and putters;

Provides sweet-spot spring effect for all gradations and types of club heads;

Positions impact surface of a club optimally behind and laterally close to a club shaft for minimizing change of contact angle of a club face with a golf ball from impact; and Provides a means for finer increments of face angle loft and handle angle lie than practical for conventional and standardized golf clubs.

This invention accomplishes the above and other objectives with an adjustable head golf club having a double-ended ratchet sleeve positioned with shank end ratchet teeth in ratchet relationship to shank ratchet teeth and with head end ratchet teeth in ratchet relationship to head ratchet teeth. A fastener rod is extended intermediate a club attachment base on the back side of the club head and a shank attachment base on a shank. A fastener head of the fastener rod can be buttressed either against an inward side of the club attachment base or against an outward side of a shank attachment base, depending on design preferences. A plurality of shank end ratchet teeth and shank rachet teeth is different from a plurality of head end ratchet teeth and head ratchet teeth. The shank end ratchet teeth are designedly offset circumferentially to provide vernier type adjustment of face angle loft and handle angle lie by selective circumferential positioning of the double ended ratchet sleeve between the head ratchet teeth and the shank ratchet teeth. A second impact face in place of a conventional sole provides a putting face that simulates conventional putters with weight of the head horizontally in line with a ball to be struck and with a more effective lie angle for putting. For closed positioning of a telescopically closeable handle for travel mode, a lock ring on the shaft is eccentric to maintain closed mode conveniently.

The above and other objects, features and advantages of the present invention will become apparent to those skilled in the art upon a reading of the following detailed description when taken in conjunction with the drawings wherein there is shown and described an illustrative embodiment of the invention.

BRIEF DESCRIPTION OF DRAWINGS

This invention is described by appended claims in relation to description of a preferred embodiment with reference to the following drawings which are described briefly as follows:

FIG. 1 is a partially cutaway sectional side view of a golf club head with a lever for loosening a selector ring for adjustment;

FIG. 2 is a cutaway sectional view showing greater detail of the adjustment features of the FIG. 1 illustration;

FIG. 13 is a partially cutaway top view of an adjustable golf club head with an adjustment radius for locating select loft numbers;

FIG. 14 is a shank end view of the FIG. 13 illustration;

FIG. 15 is a sectional elevation view of a club side of a shank;

FIG. 16 is a partially cutaway view of an axial side of the FIG. 15 illustration;

FIG. 17 is a partially cutaway view of a fastener side of the FIG. 15 illustration;

FIG. 18 is a top view of a elliptical handle ferrule into which a round shaft fits;

FIG. 19 is a sectional top view of a flattened circumference of a selector ring in relationship to flattened circumferences of a club attachment base and a shank attachment base; and.

DESCRIPTION OF PREFERRED EMBODIMENT

Figure 3:
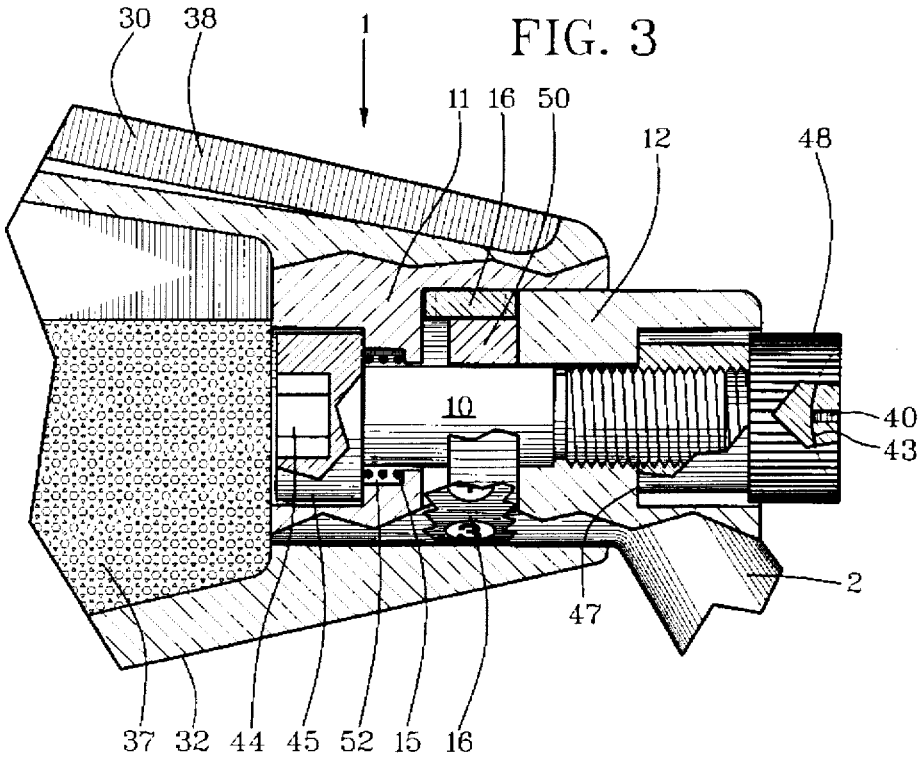
FIG. 3 is a cutaway view of a section with alternatively washer, slug or coin adjustment and having a single socket head bolt and sleeve nut for adjustment.

Reference is made first to FIG. 1. An adjustable golf club head 1 is attached to a shank 2 of a handle 3 with a shank side bolt 4 that is machine-threaded and has a fastener head 5 on a shank end. The fastener head 5 is designed to fit against a shank fastener surface 6 that is extended outward radially from a shank bolt hole 7 on a fastening side 8 of the shank 2 to provide a fastener means on the shank 2. A machine threaded coupling 9 having an internal periphery sized and shaped to receive the shank side bolt 4 and an anchor bolt 10 from opposite directions threadably is positioned in internal peripheries of a club attachment base 11 and a shank attachment base 12. The anchor bolt 10 can have a bolt head that is a flat socket head 13 anchored to a club side 14 of the club attachment base 11.

A click spring 15 is provided with expansion pressure between the club attachment base 11 and a bolt head that can be the flat socket head 13. The click spring 15 thereby draws the club attachment base 11 and the shank attachment base 12 together with select resilience when the shank side bolt 4 is screwed selectively out of the coupling 9. When the club attachment base 11 and the shank attachment base 12 can be separated against resilience of the click spring 15, a selector ring 16 comprised of a double ended ratchet sleeve can be rotated between the club attachment base 11 and the shank attachment base 12.

Figure 19:
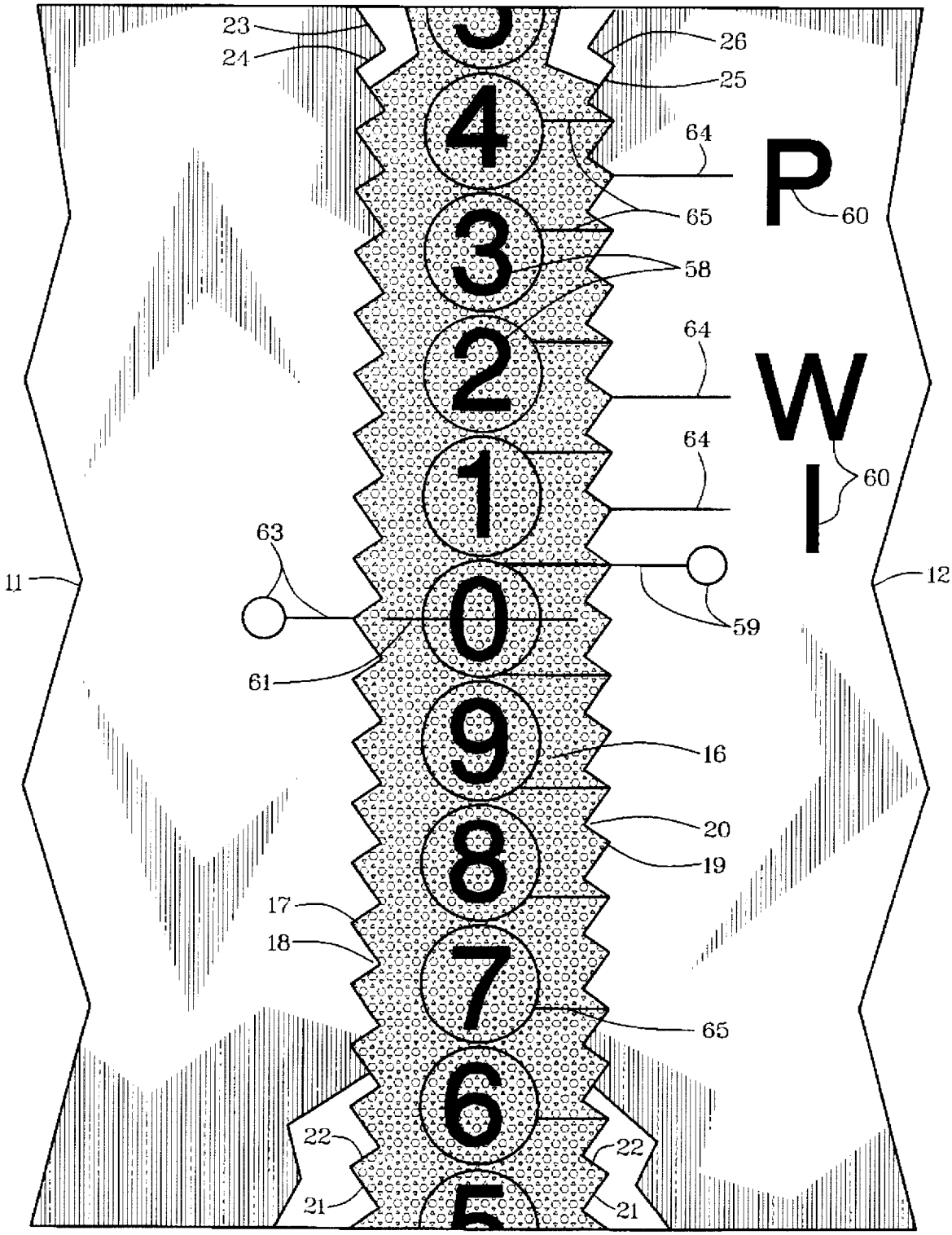

Referring to FIGS. 1 and 19, the selector ring 16 has a design plurality of head-end ratchet teeth 17 equal to a design plurality of head ratchet teeth 18 and a design plurality of shank end ratchet teeth 19 equal to a design plurality of shank ratchet teeth 20. The head end ratchet teeth 17 are positioned circumferentially on a head end and the shank end ratchet teeth 19 are positioned on circumferentially on a shank end of the double ended ratchet sleeve which is the selector ring 16. Selector ramps 21 on the head end ratchet teeth 17 and on the shaft end ratchet teeth 19 are oppositely sloped to provide unidirectional ratchet control of rotation of the selector ring 16 between the head ratchet teeth 18 and shank ratchet teeth 20. Contact surfaces of the ramps 21 and of selector end walls 22, of the head end ratchet teeth 17 and the shank end ratchet teeth 19 are positioned in planes that are parallel to ratchet contact surfaces of head ramps 23, head end walls 24, shank ramps 25 and shank end walls 26 respectively. Preferably but not necessarily, ramp angles can be 55 degrees and the wall angles can be 35 degrees from an axis of the selector ring 16, such that the ramps 21, 23 and 25 are at right angles with end walls 22, 24 and 26 respectively. The ratchet components, particularly the ramps and walls, are distinguished more clearly and described with greatest detail in relation to cutaway portions of FIG. 19. Owing to drawing compactness, the ramps and walls are shown but not numbered separately in FIG. 1.

The shank side bolt 4 can be rotated with a noninterference wrench means that can be a locking lever 27. The locking lever 27 can be attachable to or variously attached to the shank side bolt 4 and positioned parallel to the shank 2 in a locked mode as shown in FIG. 1. The locking lever 27 can be shaped as desired to fit under the shank 2 for noninterference with use conditions.

Figure 7:
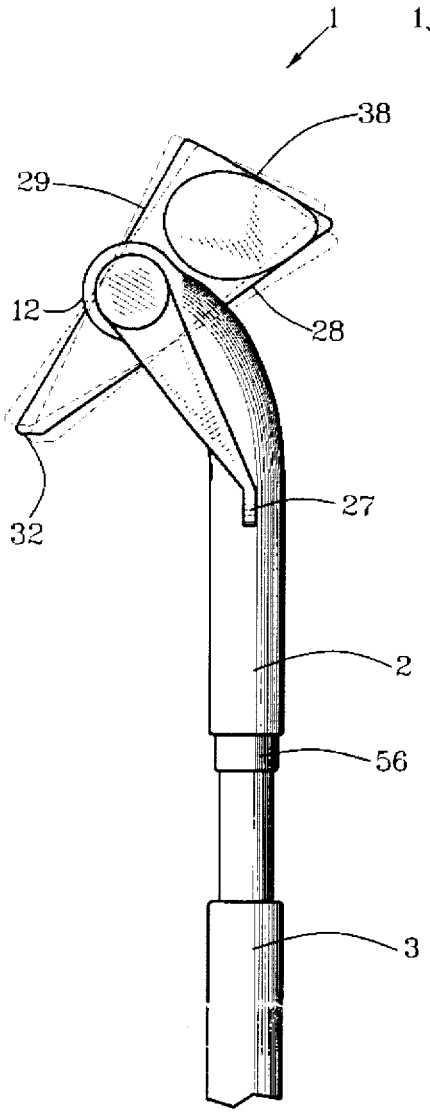
FIG. 7 is an inverted sectional elevation view of an adjustment side of a shank having a lever adjustment and showing typical loft relationships.

Referring to FIGS. 1 and 7 14, the adjustable golf-club head 1 has an impact face 28, a back 29, a bottom 30, an outside end 31, a top 32 and an inside end 33. The club attachment base 11 is on an inside end wall on the back 29. The adjustable golf club head 1 is shown upside down and from the rear in FIG. 1 because this is the attitude in which it is held for adjustment of loft and lie. It is on the back 29 that adjustment components are positioned and that adjustment indicators are inscribed upside down from use attitude.

On the back side 29 as shown in FIG. 1, there are the club attachment base 11 as an inside end wall, a bottom wall 34, an outside end wall 35 and a top wall 36 that surround a sweet spot 37. The sweet spot 37 is a thin wall on back of the impact face 28.

A putting face 38 is positioned on a face of the bottom wall 34 as illustrated in FIGS. 1–3, 6–8, 11–12 and 14. The putting face 38 replaces a sole on a head of a head of a conventional golf club. This simulates structure of idealized conventional putters by positioning weight of the head directly aft of the putting face 38 in a selectively horizontal attitude. The impact face 28 is about 114 degrees from the putting face 38 mathematically as shown in FIG. 9.

Figure 4:
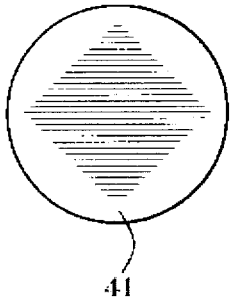
FIG. 4 is a front view of a coin or slug that can be used as an adjustment wrench.
Figure 5:
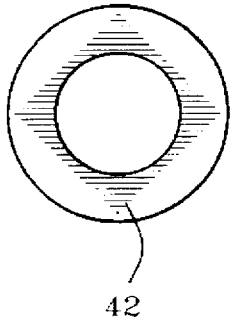
FIG. 5 is a front view of a washer that can be used as an adjustment wrench.
Figure 6:
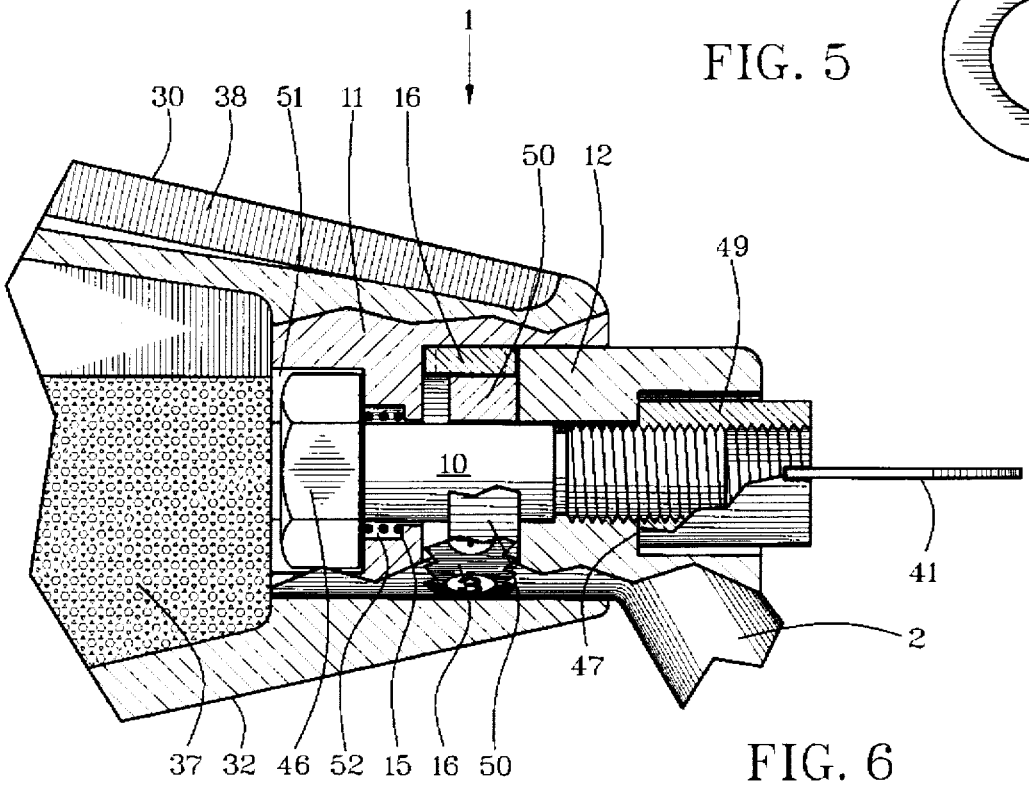
FIG. 6 is a cutaway view of a section without knob adjustment and having a single hex bolt and sleeve nut for adjustment.

Referring to FIG. 2, the coupling 9 is shown with a set screw 39 to arrest its rotation when the shank side bolt 4 is turned in rotational opposition to the anchor bolt 10. The fastener head 5 is shown with at least one screwdriver channel 40 into which a flat object can be inserted as a noninterference wrench means to rotate the shank side bolt 4. The flat object can be disc-shaped such as a slug or coin 41 shown in FIG. 4, a washer 42 shown in FIG. 5 or either a disc or washer as depicted in FIG. 6. The screwdriver channel 40 can have an arcuate channel bottom 43 with arcuate walls to arrest side travel of the disc shaped object out of the screwdriver channel 40 laterally. The anchor bolt 10 can have a flat socket head 13 or other form of fastener head with a head socket 44. An advantage of the arcuate screwdriver channel 40 is that a user will usually have a coin that fits into it to make it a coin lock. Because this is an illegal use of coins, slugs or washers are recommended, even though the noninterference wrench means is referred to as a coin lock. An advantage of a washer is its ease of attachment to a key chain as a handy wrench.

Referring now to FIGS. 3–6, the fastener rod can be an anchor bolt 10 having a bolt head such as a socket head 45 shown in FIG. 3 or a hex head 46 shown in FIG. 6. A machine threaded end of the anchor bolt 10 can be extended from the bolt head at an inside end of the club attachment base 11 and positioned in a design fastener nut that buttresses against a countersunk wall 47 in a fastener side of the shank attachment base 12. The design fastener nut is preferably a knob coin-lock nut 48 as shown in FIG. 3 or a plain coin lock nut 49 as shown in FIG. 6. A selector bearing 50 can be positioned on the anchor bolt 10 to support the selector ring 16 and to provide linear support for the click spring 15. The hex head 46 can be constructed with sufficient cross-sectional area to provide a spring base and to seat in a hex socket 51 in the club attachment base 11 in order to arrest its rotation in opposition to rotation of the design fastener nut that is employed.

Figure 8:
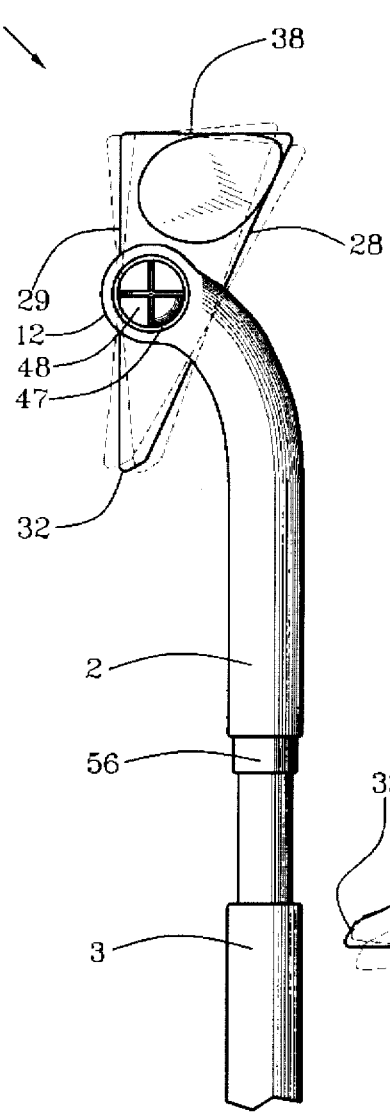
FIG. 8 is an inverted sectional elevation view of an adjustment side of a shank having coin, washer or slug adjustment and showing typical loft relationships.
Figure 9:
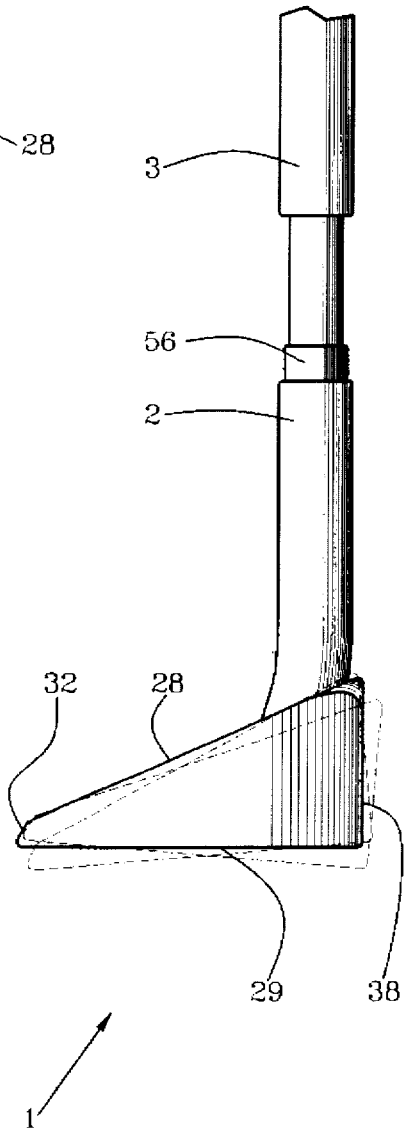
FIG. 9 is an upright sectional elevation view of a club side of a shank and showing putter loft relationships.
Figure 10:
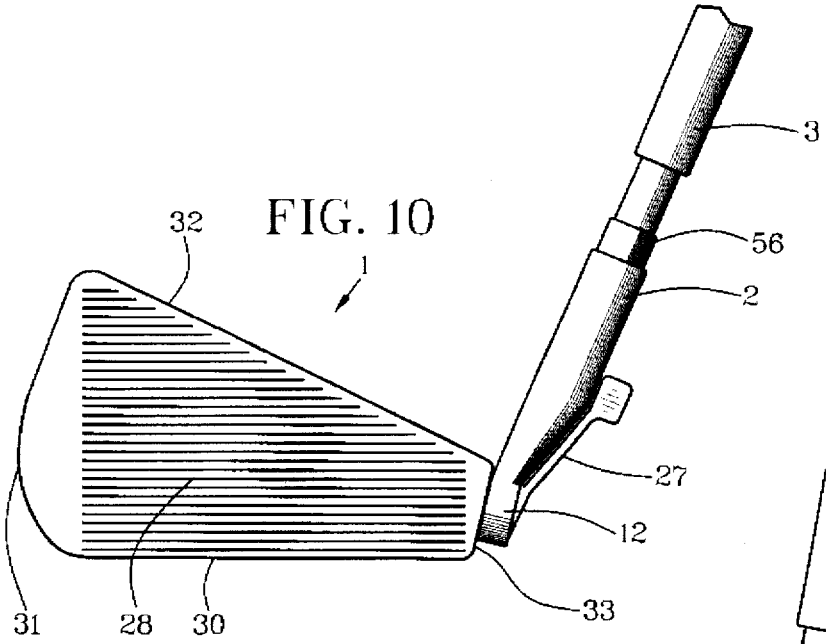
FIG. 10 is a sectional front elevation view of a head in driver adjustment with an impact face relatively vertical and a handle relatively slanted.
Figure 11:
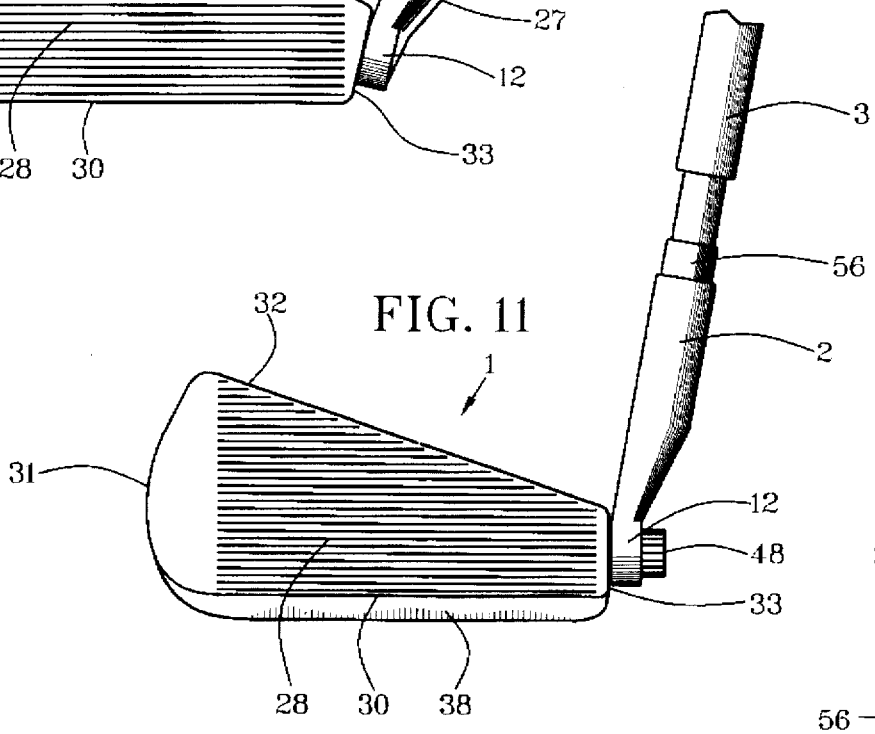
FIG. 11 is a sectional front elevation view of a head in wedge or high-iron adjustment with an impact face slanted relatively backward from a bottom of the head and with the handle relatively near verticality.
Figure 12:
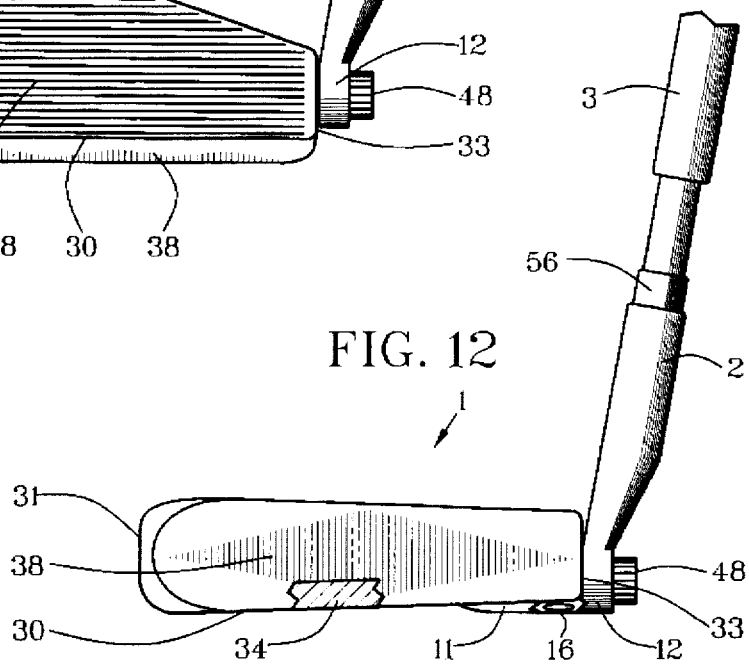
FIG. 12 is a sectional front elevation view of a head in an optional putter attitude with the handle relatively near verticality for optimizing putting vision and control.

Referring to FIGS. 1–3 and 6–12, angularity of the bottom 30 on which the putting face 38 is positioned is about 13 degrees from the axes of the anchor bolt 10, the club attachment base 11 and the shaft attachment base 12 assembled. This causes change in lie angle of the shank 2 and handle 3 in relation to horizontal attitude of the bottom 30 and putting face 38 when the adjustable golf-club head 1 is rotated to adjust loft angle of the impact face 28 and of the putting face 38 as depicted in FIGS. 10–12. For example, in FIG. 10 the impact face 28 is relatively vertical and the shank 2 is relatively slanted for various putting and driver preferences. In FIG. 11, the impact face 28 is slanted backward in mid-iron mode with the putting face 38 appearing below the bottom 30, with the shank 2 less slanted and with less height of the impact face 28 visible from a front view. In FIG. 12, the putting face 38 is shown vertical in a putting mode in which the impact face 28 is not visible. The club attachment base 11 and the selector ring 16 are visible below the putting face 38. The bottom wall 34 is shown aft of the putting face 38 in a cutaway section.

In FIG. 13, an inside periphery of the club attachment base 11 has a spring enclosure 52 in which the click spring 15 can be positioned between a spring wall 53 and a head of an anchor bolt 10 while the anchor bolt 10 is positioned in sliding contact with a bolt enclosure 54 as illustrated in FIGS. 1–2. In FIGS. 3 and 6 the selector bearing 50 provides functions similar to those of the spring wall 53 and the bolt enclosure 54 in FIGS. 1–2 and 13. Also shown in FIG. 13 is an alignment radius 62 which will be explained further in relationship to FIG. 20.

Referring to FIGS. 13–14 and 19, the head ramps 23 and head end walls 24 of the head ratchet teeth 18 are positioned circumferentially on the club attachment base 11.

Referring to FIGS. 15–16 and 1–2, shank ramps 25 and shank end walls 26 are positioned circumferentially on the shank attachment base 12. A twelve cornered socket 55 or other rotational resistance means can be positioned on an internal periphery of the shank attachment base 12 to arrest rotation of a coupling 9 shown in FIGS. 1–2 with matching socket corners to prevent rotation of the coupling 9 and to adjust the locking lever 27 to a position of parallel to the shank 2.

Referring to FIGS. 15–17, shank 2 is curved rearward from the handle 3 as shown from a head side in FIG. 15 and from a fastener side in FIG. 17. As illustrated in FIG. 16, however, there is no side curvature.

Referring to FIGS. 17–18, a ferrule or other handle attachment shaft ring 56 attached to an external periphery of the head end of handle 57 can be elliptical to receive a head end 57 of a telescopically closeable handle or other form of handle 3 in order to make the golf club collapsible for easy carrying and storage.

Referring to FIG. 19, the selector ring 16, the club attachment base 11 and the shank attachment base 12 are illustrated flattened instead of round in order to demonstrate vernier principles employed. There can be any number of head-end rachet teeth 17 and shank end ratchet teeth 19 on the selector ring 16. However, for mathematical calculations and for convenient size proportions, it is preferable that there be 22 shank end ratchet teeth 19 and 22 head end ratchet teeth 17. These numerical proportions provide ten percent more head end ratchet teeth 17 than shank end ratchet teeth 19. It follows, therefore, that in equal lengths between circumferential ends there will be ten percent difference in distances between points of the ratchet teeth 17 and 19. Thus, when a point of a ratchet tooth 17 is in line with a point of a ratchet tooth 19 as shown at center line 61, the adjacent points on both sides of the center line 61 are separated a distance equal to ten percent of a distance between two of the same points 17 or 19 respectively. This provides 220 separate circumferential settings with 1.636 degrees between each setting of the adjustable golf club head 1 on the shank 2. There being ten loft angles and related lie angles in a portion of 360 degrees for conventional golf clubs, the same or finer differences between settings can be achieved with this invention, depending on the plurality of teeth 17 and the different plurality of teeth 19. In a preferred embodiment, there are ten loft angles for irons, ten loft angles for wedges, ten loft angles for left handed irons, and ten loft angles for the putting face 38.

Typical settings are illustrated in FIGS. 7–9. A locking lever 27 shown in FIG. 7 or a coin lock nut 48 shown in FIG. 8 can be rotated to loosen the selector ring 16 and then to tighten it after a setting selection has been made. Settings shown in FIG. 7 are a high angle iron for the adjustable golf club head 1 depicted with solid lines and five degree higher and lower variations in dashed lines. In FIG. 8, the settings shown are for a low iron in solid lines and five degree variations lower and higher in dashed lines. In FIG. 9, solid lines show the putting face 38 in vertical attitude with the back 29 horizontal, the impact face 28 on top and the top 32 in an aft position. Dashed lines show five degree variations above and below verticality of the putting face 38.

One advantage of putting face adjustment is that it positions the handle 3 more nearly vertical for putting. This allows a putter's head and eyes to be positioned directly above a ball and the adjustable golf club head. Further, it allows less vertical length of handle 3 for putting control. This is in addition to a fundamental advantage of positioning head weight horizontally in line with the putting face 38.

For long distance shots, for all short range shots and for putting alike, this invention provides fine tuning accuracy of head positioning. Shown in FIG. 19 are loft numbers 58, adjustment marks 59 and mode letters 60 that can be positioned on the selector ring 16 and the shank attachment base 12 selectively in accordance with a design vernier setting ratio and in accordance with design methods that can be devised for using this invention. Some can be made very simple for amateur golfers and others can be made more complex for more professional golfers.

About one third of the 220 settings possible for a 20–22 combination of head end ratchet teeth 17 and shank end ratchet teeth 19 on a selector ring 16 are not practical because they are circumferential settings that can not be used. Thus, there is a remaining two thirds or about 145 settings that are useable.

The adjustable golf club head 1 can be ratchet-rotated in either direction, either backward or forward. Forward click ratchet rotation positions the impact face 28 one twentieth of a rotation, which is 18 degrees, forward. Rearward click ratchet-rotation positions the impact face 28 one twenty second of a rotation, which is 16.36 degrees, rearward. One click in each direction rotates the impact face 28 the difference between 18 degrees and 16.36 degrees, which is 1.64 degrees.

Settings of irons of conventional golf clubs are between three and five degrees apart. Thus, settings with this invention permit approximately two settings for each single iron difference setting of conventional golf clubs.

Figure 20:
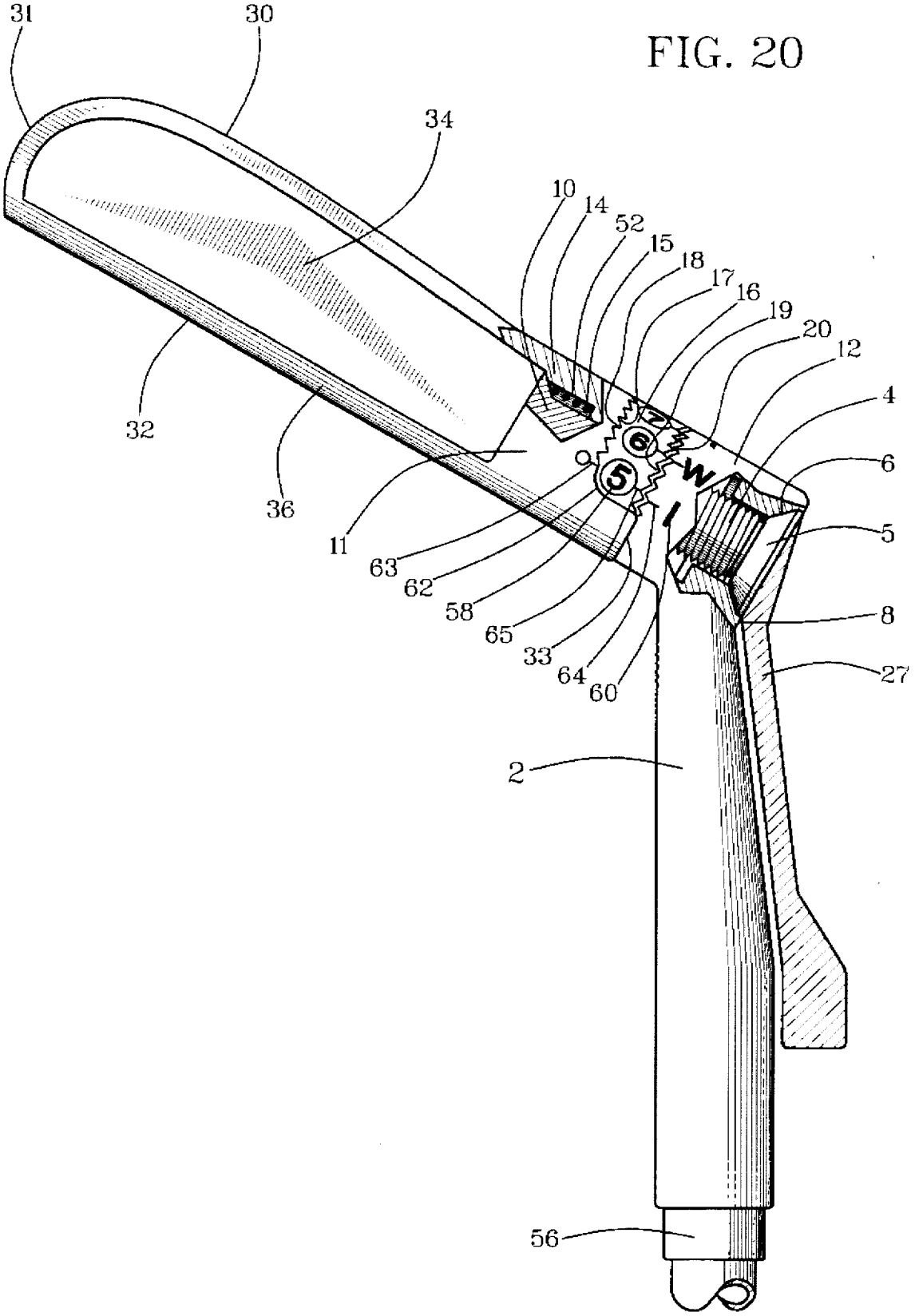
FIG. 20 is a partially cutaway sectional view in adjustment attitude.

Referring to FIG. 20, a preferred method for using loft adjustment features of this invention is first to hold the shank 2 in an inverted attitude with the adjustable golf club head 1 on a left side of the shank 2 for ease of access to adjustment means. Then the locking lever 27 or other wrench means is rotated to loosen the club attachment base 11 and the shank attachment base 12 from ratchet-engagement contact with the selector ring 16. The selector ring 16 is then rotated to position a desired loft number 58 within an alignment radius 62. The alignment radius 62 is a juncture of a half circle sleeve and a full circle sleeve proximate the inside end 33 of the club attachment base 11. The alignment radius 62 is sized to provide visibility of about a quarter circle of an inscription circle surrounding loft angle numbers 58 on the selector ring 16.

In this example, the loft angle number 5 is positioned in the alignment radius 62 as an illustration. Then the club attachment base 11 and the selector ring 16 are held together in a ratchet engagement relationship while circumferential relationship between the shank attachment base 12 and the selector ring 16 is adjusted rotationally to position a desired mode letter 60 in line with the selected loft number 58. In this illustration, "I" for iron is the mode letter 60 that is positioned rotationally to be in line with the selected loft number 58 which is 5. Rotational positioning can be accomplished by rotating either or both of the shank attachment base 12 and a held together combination of the selector ring 16 and the club attachment base 11. This setting provides a five iron loft angle. Half-loft adjustments from this or other loft settings are then achieved by rotating the club attachment base 11 one click in each direction circumferentially in relationship to the shank attachment base 12. This provides incrementally accurate loft settings towards a progressively lower iron loft. When a desired loft setting is attained, the locking lever 27 is rotated in a tightening direction that engages the club attachment base 11 and the shank attachment base 12 rigidly by ratchet engagement to the selector ring 16.

The club attachment base 11 and the selector ring 16 are shown close together with no distinction between the adjacent edges. This depicts that they are being maintained in ratchet engagement relationship while the shank attachment base 12 and the selector ring 16 are separated to allow a clicking rotation of one against the other when tightness of the anchor bolt 10 is adjusted properly.

Loft angle settings for putting and for wedges are accomplished in the same manner with the selected loft number 58 being aligned with a putting mode letter 60 and with a wedge mode letter 60 selectively. The mode letters 60 are on the shank attachment base 12 as shown in FIGS. 19–20. Preferably, the mode letter 60 for iron settings is "I"; the mode letter 60 for putting settings is "P"; and the mode letter 60 for wedge settings is "W".

Sixty accurate settings are provided in this manner with this particular combination of pluralities of ratchet teeth 17–20.

Optional to the alignment radius 62 described in relation to FIG. 20 for aligning a loft number 58, an alignment mark 63 can be positioned on the club attachment base 11 as shown in FIG. 19. Instead of positioning a loft number 58 in the alignment radius 62, a desired loft number 58 is centered as nearly as possible to the alignment mark 63 while the same procedures are followed as for the alignment radius 62. Either or both the alignment radius 62 and the alignment mark 63 can be provided and used on a club attachment base 11 for particular design and use preferences. Both are types of alignment indicators.

By rotating a club head to a position in which a loft number 58 is visible in the alignment radius 62 and an adjustment mark 59 is on a select mode letter 60, a total of thirty iron, wedge and putting settings can be made. An optional putting or driver mode using the impact face 28 in select verticality and equally complete left handed positions can be used in addition to all of the above setting features. Left handed settings are reciprocals of right-handed settings.

Referring to FIGS. 19–20, mode letter lines 64 can be positioned at the mode letters 60 for accurate alignment with loft numbers 58. Loft alignment marks 65 at the loft numbers 58 are shown in line with the mode-letter lines 64 at a selected setting. The alignment mark 63, when used either with or without the alignment radius 62, can be positioned proximate positioning of the alignment radius 62 as shown in FIG. 20. Measuring circumferentially in a direction depicted as upward from the center line 61 in FIG. 19, mode letter lines 64 are centered on the "I", "W" and "P" mode letters 60 at the third, fifth and ninth ratchet valley intersection of the shank ramps 25 and shank end walls 26 respectively. Rachet valley intersections of the shank ramps 25 and shank end walls 26 are 16.36 degrees apart while ratchet valley intersections of the head ramps 23 and head end walls 24 are 18 degrees apart circumferentially. Correspondingly, the shank end ratchet teeth 19 are 16.36 degrees apart and the head end ratchet teeth 17 are 18 degrees apart.

A new and useful adjustable head golf club having been described, all such modifications, adaptations, substitutions of equivalents, combinations of parts, applications and forms thereof as described by the following claims are included in invention.

I claim:

1. An adjustable head golf club comprising:

an adjustable golf club head having an impact face, a back, a bottom, an outside end, a top and an inside end;

a club attachment base on an inside end wall on the back of the adjustable golf club head;

a plurality of head ratchet teeth positioned circumferentially external from a head fastener means that is inward from an outward side of the club attachment base;

a shank having a shank attachment base with an axis of the shank attachment base designedly angular to the shank and positioned on a head end of the shank;

a plurality of shank ratchet teeth positioned circumferentially external from a shank fastener means on a head side of the shank fastener means;

a selector ring positioned between the head side of the shank fastener means and the outward side of the club attachment base;

the selector ring having linear positioning and circumferential-positioning means for positioning the adjustable golf club head linearly and selectively circumferential on the shank;

a fastener having a fastener rod positioned intermediate a fastener base side of the head fastener means and a fastener base side of the shank fastener means; and a handle attachable to the shank.

2. An adjustable head golf club as described in claim 1 wherein:

the selector ring is a double ended ratchet sleeve having a head end and a shank end.

3. An adjustable head golf club as described in claim 1 wherein:

the linear positioning and circumferential-positioning means for positioning the adjustable golf-club head linearly and selectively circumferential on the shank is a double-ended ratchet sleeve having a plurality of head end ratchet teeth equal to the plurality of head ratchet teeth and a design plurality of shank end ratchet teeth equal to the plurality of the shank ratchet teeth;

the head end ratchet teeth are positioned circumferentially on a head end of the double ended ratchet sleeve;

the shank end ratchet teeth are positioned circumferentially on a shank end of the double ended ratchet sleeve;

the head end ratchet teeth have ramps that are oppositely sloped from ramps of shank end ratchet teeth on the double ended ratchet sleeve;

the head ratchet teeth have ramps that are oppositely sloped from ramps of shank ratchet teeth on the shank;

ratchet contact surfaces of end walls and of the ramps of the head end ratchet teeth lie in planes parallel to ratchet contact surfaces on end walls and of the ramps of the head ratchet teeth;

ratchet contact surfaces of end walls of the ramps of the shank end ratchet teeth lie in planes parallel to ratchet contact surfaces of end walls of the ramps of the shank ratchet teeth;

the end walls and ramps of the head end ratchet teeth are sized, shaped and positioned to fit against the end walls of the ramps of the head ratchet teeth circumferentially;

the end walls and ramps of the shank end ratchet teeth are sized, shaped and positioned to fit against the end walls of the ramps of the shank ratchet teeth circumferentially; and the double ended ratchet sleeve is selectively positioned circumferentially and linearly intermediate the shank and the adjustable head golf club with the fastener rod.

4. An adjustable head golf club as described in claim 3 wherein:

the plurality of head ratchet teeth and head end ratchet teeth is different from the plurality of shank ratchet teeth and shank end ratchet teeth.

5. An adjustable head golf club as described in claim 4 wherein:

the plurality of head ratchet teeth and head end ratchet teeth is 20 and the plurality of shank ratchet teeth and shank end ratchet teeth is 22 respectively.

6. An adjustable head golf club as described in claim 1 and further comprising:

a bottom wall on the bottom of the adjustable golf club head at a angle in excess of perpendicularity from the impact face and extended rearward from the impact face;

an outside end wall extended rearward from an outside edge of the impact face;

a top wall extended rearward from a top edge of the impact face;

an inside end wall extended rearward from an inside end of the impact face; and the bottom wall, the outside end wall, the top wall and the inside end wall form a configuration of the back of the adjustable golf club head with a thin and resilient impact section known generally as a sweet spot intermediate the impact face and the back of the adjustable golf club head and inwardly from the bottom wall, the inside end wall, the top wall and the inside-end wall of the adjustable golf club head which border a back side of the sweet spot.

7. An adjustable golf club as described in claim 1 wherein:

the shank attachment base is offset laterally from an axis of the handle.

8. An adjustable head golf club as described in claim 1 and further comprising:

a handle attachment shaft ring that is designedly out-of-round and positioned on the shaft to receive a head end of a telescopically closeable handle with snugness in closed mode of the telescopically closeable handle.

9. An adjustable head golf club as described in claim 1 wherein:

the bottom of the adjustable golf club head has a putting face with a design angle in excess of perpendicularity from the impact face and extended rearward from the impact face.

10. An adjustable head golf club as described in claim 9 wherein:

an axis of a fastener rod with which the adjustable head golf club is fastened to the shank attachment base is positioned about ten degrees circumferentially from the putting face.

11. An adjustable head golf club as described in claim 10 wherein:

the angle in excess of perpendicularity from the impact face at which the putting face is extended rearward from the impact face is about 114 degrees.

12. An adjustable head golf club as described in claim 6 wherein:

the bottom of the adjustable golf club head has a putting face with a angle in excess of perpendicularity from the impact face and extended rearward from the impact face.

13. An adjustable head golf club as described in claim 12 wherein:

an axis of a fastener rod with which the adjustable head golf club is fastened to the shank attachment base is positioned about ten degrees circumferentially from the putting face.

14. An adjustable head golf club as described in claim 13 wherein:

the angle in excess of perpendicularity from the impact face at which the putting face is extended rearward from the impact face is about 114 degrees.

15. An adjustable head golf club as described in claim 1 wherein:

the linear positioning and circumferential-positioning means for positioning the adjustable golf club head linearly and selectively circumferential on the shank is a double ended ratchet sleeve having a plurality of head-end ratchet teeth equal to the plurality of the head ratchet teeth and a design plurality of shank end ratchet teeth equal to the plurality of the shank ratchet teeth;

the head end ratchet teeth are positioned circumferentially on a head end of the double ended ratchet sleeve;

the shank end ratchet teeth are positioned circumferentially on a shank end of the double ended ratchet sleeve;

the head end ratchet teeth have ramps that are oppositely sloped from ramps on shank end ratchet teeth on the double ended ratchet sleeve;

the head ratchet teeth have ramps that are oppositely sloped from ramps on shank ratchet teeth on the shank;

ratchet contact surfaces of end walls of the ramps of the head end ratchet teeth are positioned in planes parallel to ratchet contact surfaces of end walls of the ramps of the head ratchet teeth;

ratchet contact surfaces of end walls of the ramps of the shank end ratchet teeth are positioned in planes parallel to ratchet contact surfaces of end walls of the ramps of the shank ratchet teeth;

the end walls and ramps of the head end ratchet teeth are sized, shaped and positioned to fit against the end walls of the ramps of the head ratchet teeth circumferentially;

the end walls and ramps of the shank end ratchet teeth are sized, shaped and positioned to fit against the end walls of the ramps of the shank ratchet teeth circumferentially;

the double ended ratchet sleeve is selectively positioned circumferentially and linearly intermediate the shank and the adjustable head golf club with the fastener rod;

the bottom wall on the bottom of the adjustable golf club head is extended a angle in excess of perpendicularity from the impact face and extended rearward from the impact face;

an outside end wall is extended rearward from an outside edge of the impact face;

a top wall is extended rearward from a top edge of the impact face;

an inside end wall is extended rearward from an inside end of the impact face; and the bottom wall, the outside end wall, the top wall and the inside-end wall form a configuration of the back of the adjustable golf club head with a thin and resilient impact section known generally as a sweet spot intermediate the impact face and the back of the adjustable golf club head and inwardly from the bottom wall, the inside end wall, the top wall and the inside-end wall of the adjustable golf club head which border a back side of the sweet spot.

16. An adjustable head golf club as described in claim 15 wherein:

the bottom of the adjustable club head has a putting face with a angle in excess of perpendicularity from the impact face and extended rearward from the impact face.

17. An adjustable head golf club as described in claim 16 wherein:

an axis of a fastener rod with which the adjustable head golf club is fastened to the shank attachment base is positioned about ten degrees circumferentially from the putting face.

18. An adjustable head golf club as described in claim 17 wherein:

the angle in excess of perpendicularity from the impact face at which the putting face is extended rearward from the impact face is about 114 degrees.

19. An adjustable head golf club as described in claim 17 wherein:

the fastener rod is a shank side bolt that is machine threaded and has a fastener head on a shank end of the shank side bolt;

the fastener head is designed to fit against a shank fastener surface that is extended outward radially from a shank bolt hole in the shank fastener means;

the shank fastener surface is on a fastening side of the shank fastener means;

a machine threaded coupling having an internal periphery sized and shaped to receive the shank side bolt and an anchor bolt from opposite directions threadably is positioned in internal peripheries of the club attachment base and the shank attachment base; and the anchor bolt has a bolt head anchored to a club side of the club attachment base.

20. An adjustable head golf club as described in claim 19 and further comprising:

a click spring having expansion pressure intermediate the club attachment base and the anchor bolt.

21. An adjustable head golf club as described in claim 20 and further comprising:

a noninterference wrench means on the fastener head.

22. An adjustable head golf club as described in claim 21 wherein:

the noninterference wrench means is a locking lever attached to the fastener head and extended from the fastener head at a angle proximate an angle of an axis of the shank bolt hole in relationship to the shank; and the locking lever is sized and shaped to fit behind the shank with the machine threaded bolt in tightly screwed relationship between the shank attachment base and the club attachment base.

23. An adjustable head golf club as described in claim 22 wherein:

a cornered socket is positioned on an internal periphery of the shank attachment base to allow adjustment of the locking lever to a position parallel to the shank.

24. An adjustable head golf club as described in claim 21 wherein:

the noninterference wrench means is a coin lock having at least one screwdriver channel extended about diametrically from side to side of the fastener head;

width of the at least one screwdriver channel is to receive slidingly a flat object; and a bottom wall of the at least one screwdriver channel is arcuately configured to match an arcuate outside portion of a periphery of the flat object.

25. An adjustable head golf club as described in claim 24 wherein:

the flat object is a desired coin, such that a washer, a flat key with an arcuate end equal to an arcuate section of the desired coin, a washer having a width and diameter about the same as the desired coin, the coin or other flat object that is similarly shaped and conveniently carried can be used in screwdriver like manner for turning the fastener head while arcuate form of the bottom wall of the at least one screwdriver channel arrests side travel of the flat object out of the at least one screwdriver channel laterally.

26. An adjustable head golf club as described in claim 17 wherein:

the fastener rod is a machine threaded anchor bolt having a bolt head on a club end;

the anchor bolt is extended from the bolt head at an inside end of the club attachment base to the fastener side of the shank fastener means and into a fastener nut;

the bolt head on the club end is sized and shaped to fit circumferentially against the inside end of the club attachment base;

the design fastener nut is provided with a nut face designed to fit against a shank fastener surface that is extended outward radially from a shank bolt hole in the shank fastener means;

the shank fastener surface is on a fastening side of the shank fastener means; and a machine threaded bolt hole sized and shaped to receive the machine-threaded fastener bolt threadably is positioned in the fastener nut.

27. An adjustable head golf club as described in claim 26 and further comprising:

a click spring having expansion pressure intermediate the shank attachment base and the anchor bolt.

28. An adjustable head golf club as described in claim 26 and further comprising:

a noninterference wrench means on the fastener nut.

29. An adjustable head golf club as described in claim 28 wherein:

the noninterference wrench means is a coin lock having at least one screwdriver channel extended about diametrically from side to side of the fastener head;

width of the at least one screwdriver channel is to receive slidingly a flat object; and a bottom wall of the at least one screwdriver channel is arcuately configured to match an arcuate outside portion of a periphery of the flat object.

30. An adjustable head golf club as described in claim 29 wherein:

the desired flat object is a coin, such that a washer, a flat key with an arcuate end equal to an arcuate section of the coin, a washer having a width and diameter about the same as the coin, the coin or other flat object that is similarly shaped and conveniently carried can be used in screwdriver-like manner for turning the fastener head while arcuate form of the bottom wall of the at least one screwdriver channel arrests side travel of the flat object out of the at least one screwdriver channel laterally.

31. An adjustable head golf club as described in claim 1 wherein:

the linear positioning and circumferential-positioning means for positioning the adjustable golf club head linearly and selectively circumferential on the shank is a double ended ratchet sleeve having a plurality of head-end ratchet teeth equal to the plurality of the head ratchet teeth and a design plurality of shank end ratchet teeth equal to the plurality of shank ratchet teeth;

the head end ratchet teeth are positioned circumferentially on a head end of the double-ended ratchet sleeve;

the shank end ratchet teeth are positioned circumferentially on a shank end of the double ended ratchet sleeve;

the head end ratchet teeth have ramps that are oppositely sloped from ramps of shank end ratchet teeth on the double-ended ratchet sleeve;

the head ratchet teeth have ramps that are oppositely sloped from ramps of shank ratchet teeth on the shank;

ratchet contact surfaces of end walls and of the ramps of the head end ratchet teeth are positioned in planes that are parallel to ratchet contact surfaces on end walls of the ramps of the head ratchet teeth;

ratchet contact surfaces of end walls and of the ramps of the shank end ratchet teeth are positioned in planes that are parallel to ratchet contact surfaces on end walls of the ramps of the shank ratchet teeth;

the end walls and ramps of the head end ratchet teeth are sized, shaped and positioned to fit against the end walls of the ramps of the head ratchet teeth circumferentially;

the end walls and ramps of the shank end ratchet teeth are sized, shaped and positioned to fit against the end walls of the ramps of the shank ratchet teeth circumferentially;

the double-ended ratchet sleeve is selectively positioned circumferentially and linearly intermediate the shank and the adjustable-head golf club with the fastener rod;

the plurality of head ratchet teeth and head end ratchet teeth is different from the plurality of shank ratchet teeth and shank end ratchet teeth respectively;

one of the plurality of head end ratchet teeth is in line linearly with one of the plurality of shank end ratchet teeth on the double-ended ratchet sleeve;

circumferential positioning of remaining plurality of head end ratchet teeth are offset a circumferential portion of circular degrees from circumferential positioning of remaining plurality of shank end ratchet teeth in proportion to circumferential spacing of the head end ratchet teeth relative to circumferential spacing of the shank end ratchet teeth on the double ended ratchet sleeve;

loft numbers related designedly to loft angles of at least one impact face are inscribed in proximity to the head end ratchet teeth and to the shank end ratchet teeth circumferentially on an outside periphery of the double-ended ratchet sleeve; and one of the loft numbers is in line linearly with the one of the plurality of the head end ratchet teeth that is in line linearly with the one of the plurality of the shank end ratchet teeth on the double-ended ratchet sleeve.

32. An adjustable head golf club as described in claim 31 and further comprising:

at least one adjustment mark on an external periphery of the shank attachment base in line with at least one select loft number.

33. An adjustable head golf club as described in claim 32 and further comprising:

at least one alignment mark on an external periphery of the club attachment base in line with at least one select loft number.

34. An adjustable head golf club as described in claim 33 and further comprising:

at least one mode letter on an external periphery of the shank attachment base at a design circumferential distance from at least one loft number.

35. An adjustable head golf club as described in claim 33 and further comprising:

an alignment indicator at a design circumferential position on an external periphery of the club attachment base.

36. An adjustable head golf club as described in claim 35 wherein:

the alignment indicator is an alignment radius on an external periphery of the club attachment base;

the alignment radius being at a juncture of a half circle sleeve and a full circle sleeve proximate the inside end of the club attachment base; and the alignment radius being sized to provide visibility of an inscription circle surrounding a select loft number on the selector ring.

37. An adjustable head golf club as described in claim 35 wherein:

the alignment indicator is an alignment mark on an external periphery of the club attachment base.

38. A method for using an adjustable head golf club comprising:

an adjustable golf club head having an impact face, a back, a bottom, an outside end, a top and an inside end;

a club attachment base on an inside end wall on the back of the adjustable golf club head;

a design plurality of head ratchet teeth positioned circumferentially external from a head fastener means that is inward from an outward side of the club attachment base;

a shank having a shank attachment base with an axis of the shank attachment base angular to the shank and positioned on a head end of the shank;

a plurality of shank ratchet teeth positioned circumferentially external from a shank fastener means on a head side of the shank fastener means;

a selector ring positioned between the head side of the shank fastener means and the outward side of the club attachment base;

the selector ring having linear positioning and circumferential-positioning means for positioning the adjustable golf club head linearly and selectively circumferential on the shank;

a fastener having a fastener rod positioned intermediate a fastener base side of the head fastener means and a fastener base side of the shank fastener means;

loft numbers on the selector ring;

mode letters on the shank attachment base;

a click spring having expansion pressure intermediate the shank attachment base and an anchor bolt; and an alignment indicator on an external periphery of the club attachment base;

the method comprising the following steps:

loosening the anchor bolt by selectively unscrewing the fastener means to provide sufficient distance between the club attachment base and the shank attachment base for the selector ring to rotate without inhibitive ratchet obstruction by ratchet teeth on the shank attachment base, on the selector ring and on the club attachment base;

circumferentially positioning a desired loft number adjacent the alignment indicator;

maintaining the club attachment base and the selector ring in ratchet engagement relationship while circumferentially positioning the loft number in select linear alignment with a mode letter; and tightening the anchor bolt by screwing the fastener means to a position of tight engagement of the head ratchet teeth and the shank ratchet teeth to the selector ring.

39. A method as described in claim 38 and further comprising the additional step of:

further adjusting loft angle before fully tightening the anchor bolt;

the further adjusting of loft angle being accomplished by select opposite-directional click rotation of the club attachment base and the shank attachment base when the anchor bolt is partially un tightened to an extent that clicking of the ratchet teeth in opposition to a click spring occurs for selective ratchet-arc rotation of the club attachment base and the shank attachment base past ratchet teeth on the selector ring; and tightening the anchor bolt by screwing the fastener means to a position of tight engagement of the head ratchet teeth and the shank ratchet teeth to the selector ring.

* * * * *